US005545953A

United States Patent [19]

Lapatovich et al.

[11] Patent Number: 5,545,953

[45] Date of Patent: Aug. 13, 1996

[54] ELECTRODELESS HIGH INTENSITY DISCHARGE LAMP HAVING FIELD SYMMETRIZING AID

[75] Inventors: Walter P. Lapatovich, Marlborough; Scott J. Butler, North Oxford, both of Mass.

[73] Assignee: Osram Sylvania Inc., Danvers, Mass.

[21] Appl. No.: 491,434

[22] Filed: Jun. 16, 1995

[51] Int. Cl.[6] ..... H05B 41/16

[52] U.S. Cl. ..... 315/248; 315/39; 313/234

[58] Field of Search ..... 315/39, 236, 246, 315/267, 344; 313/153, 234, 634

[56] References Cited

U.S. PATENT DOCUMENTS

| | | | |
|---|---|---|---|
| 5,070,277 | 12/1991 | Lapatovich | 315/248 |
| 5,113,121 | 5/1992 | Lapatovich et al. | 315/248 |
| 5,130,612 | 7/1992 | Lapatovich et al. | 315/248 |
| 5,144,206 | 9/1992 | Butler et al. | 315/248 |
| 5,241,246 | 8/1993 | Lapatovich et al. | 315/248 |
| 5,280,217 | 1/1994 | Lapatovich et al. | 315/39 |

*Primary Examiner*—Robert Pascal
*Assistant Examiner*—David H. Vu
*Attorney, Agent, or Firm*—Carlo S. Bessone

[57] ABSTRACT

An electrodeless high intensity discharge lamp includes an electrodeless lamp capsule, first and second electric field applicators positioned so that the lamp capsule is between the electric field applicators, and a planar transmission line. The planar transmission line couples high frequency power from an input to the first and second electric field applicators and has a gap with in which the lamp capsule is positioned. A field symmetrizing conductor, preferably a thin wire, is located in an open side of the gap and is electrically connected to the ground plane of the planar transmission line. The field symmetrizing conductor is positioned such that the electric field in the lamp capsule is substantially symmetrical with respect to the lamp axis and is substantially colinear with the lamp axis.

17 Claims, 4 Drawing Sheets

ELECTRODELESS HIGH INTENSITY DISCHARGE LAMP HAVING FIELD SYMMETRIZING AID

FIELD OF THE INVENTION

This invention relates to electrodeless high intensity discharge lamps and, more particularly, to electrodeless high intensity discharge lamps wherein the tendency for overheating of the lamp capsule wall during operation is reduced by energizing the lamp capsule with an electric field that is substantially symmetrical with respect to the lamp axis and is substantially colinear with the lamp axis.

BACKGROUND OF THE INVENTION

Electrodeless high intensity discharge (HID)lamps have been described extensively in the prior art. In general, electrodeless HID lamps include an electrodeless lamp capsule containing a volatilizable fill material and a starting gas. The lamp capsule is mounted in a fixture which is designed for coupling high frequency power to the lamp capsule. The high frequency power produces a light-emitting plasma discharge within the lamp capsule. Recent advances in the application of microwave power to lamp capsules operating in the tens of watts range are disclosed in U.S. Pat. No. 5,070,277 issued Dec. 3, 1991 to Lapatovich; U.S. Pat. No. 5,113,121 issued May 12, 1992 to Lapatovich et al.; U.S. Pat. No. 5,130,612 issued Jul. 14, 1992 to Lapatovich et al.; U.S. Pat. No. 5,144,206 issued Sep. 1, 1992 to Butler et al.; and U.S. Pat. No. 5,241,246 issued Aug. 31, 1993 to Lapatovich et al. As a result, compact electrodeless HID lamps and associated applicators have become practical.

The above patents disclose small cylindrical lamp capsules wherein high frequency energy is coupled to opposite ends of the lamp capsule with a 180° phase shift. The applied electric field is generally colinear with the axis of the lamp capsule and produces a substantially linear discharge within the lamp capsule. The fixture for coupling high frequency energy to the lamp capsule typically includes a planar transmission line, such as a microstrip transmission line, with electric field applicators, such as helices, cups or loops, positioned at opposite ends of the lamp capsule. The microstrip transmission line couples high frequency power to the electric field applicators with a 180° phase shift. The lamp capsule is typically positioned in a gap in the substrate of the microstrip transmission line and is displaced above the plane of the substrate by a few millimeters so that the axis of the lamp capsule is colinear with the axes of the field applicators.

The electrodeless HID lamps disclosed in the prior art provide highly satisfactory performance. However, in some cases, arc bowing and overheating of the lamp capsule wall have been observed. In extreme cases, the discharge within the lamp capsule has extinguished when coming in contact with the lamp capsule wall. In other cases, overheating has caused the lamp to soften and bulge. Such operation reduces the operating life of the lamp capsule and limits the power level which can be applied to the lamp capsule.

SUMMARY OF THE INVENTION

According to the present invention, an electrodeless high intensity discharge lamp comprises an electrodeless lamp capsule having an enclosed volume containing a mixture of starting gas and chemical dopant material excitable by high frequency power to a state of luminous emission, a first electric field applicator and a second electric field applicator positioned so that the enclosed volume of the lamp capsule is between the first and second electric field applicators, and a planar transmission line. The planar transmission line comprises a substrate having a patterned conductor on a first surface for coupling high frequency power from an input to the first and second electric field applicators, and a ground plane on a second surface. The substrate and the ground plane have a gap with an open side for positioning the lamp capsule between the first and second electric field applicators. The electrodeless high intensity discharge lamp further comprises a field symmetrizing conductor located in the open side of the gap and electrically connected to the ground plane. The field symmetrizing conductor is positioned such that an electric field in the lamp capsule is substantially symmetrical with respect to the lamp axis and is substantially colinear with the axis.

Preferably, the field symmetrizing conductor comprises a thin conductive wire. The wire diameter is preferably in a range of about 0.001 inch to 0.040 inch. The wire is preferably disposed parallel to the axis of the lamp capsule and is connected to the ground plane on opposite sides of the gap. In general, the wire diameter is selected to provide relatively low inductance at the frequency of operation of the lamp and to provide relatively low blockage of light emitted by the lamp capsule, where avoiding light blockage is important.

According to another aspect of the invention, a fixture for applying high frequency power to an electrodeless lamp capsule comprises a planar transmission line and first and second electric field applicators. The planar transmission line comprises a substrate having a patterned conductor on a first surface and a ground plane on a second surface. The substrate and the ground plane have a gap with an open side for positioning the lamp capsule. The first and second electric field applicators are positioned on opposite sides of the gap and are electrically coupled to the patterned conductor. A field symmetrizing conductor is located in the open side of the gap and is electrically connected to the ground plane. The field symmetrizing conductor is positioned such that an electric field between the first and second electric field applicators is substantially symmetrical in a region between the first and second electric field applicators.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
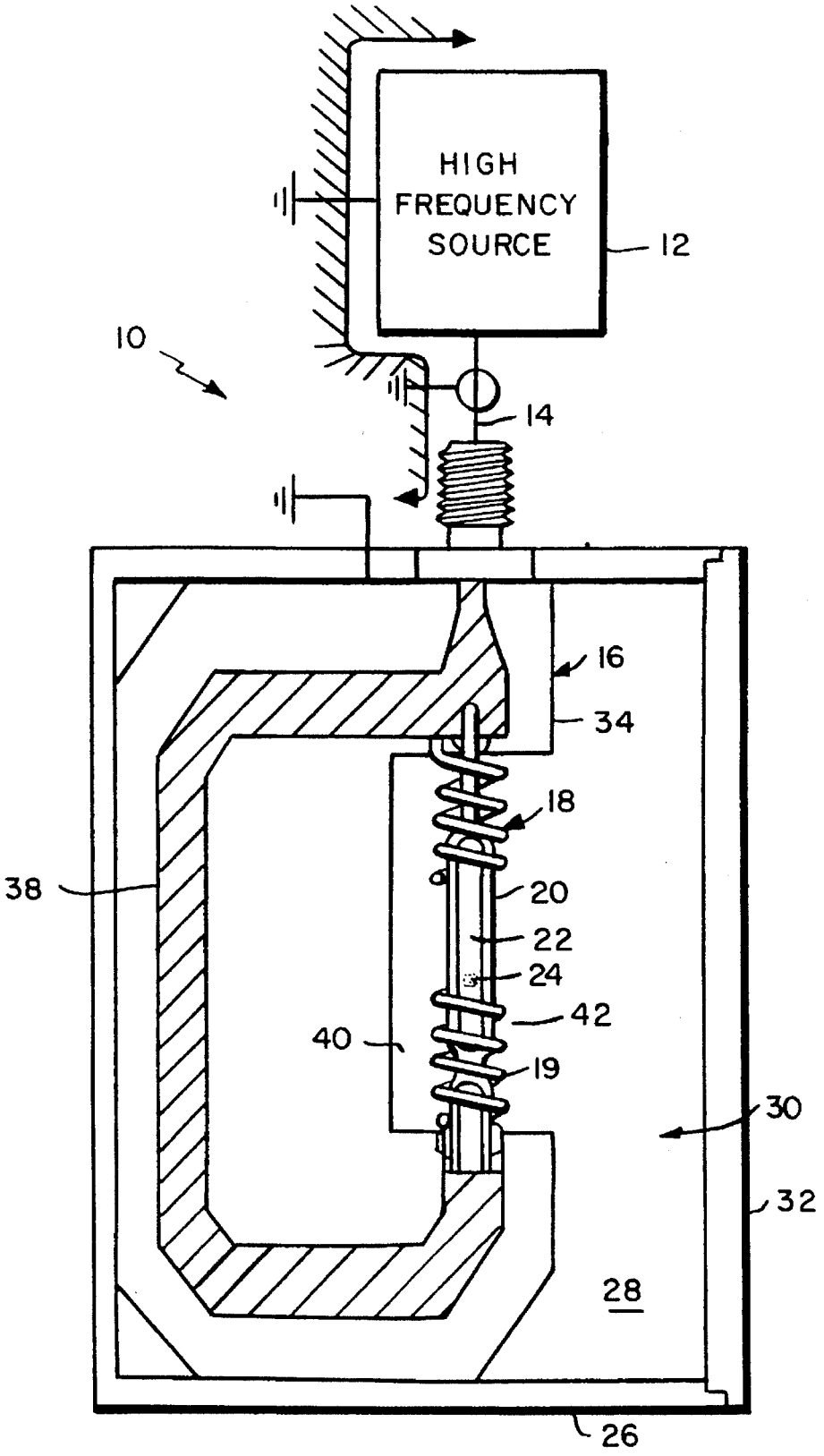
FIG. 1 PRIOR ART
FIG. 1 is a cross-sectional view of a prior art electrodeless HID lamp.

A prior art electrodeless automobile headlamp system 10 is shown in FIG. 1. The electrodeless headlamp system 10 comprises a high frequency source 12, a transmission line 14, a planar transmission line 16, electric field couplers, or applicators, 18 and 19, a lamp capsule 20 having an enclosed volume 22 containing a lamp fill material 24. The planar transmission line 16, holding the couplers 18 and 19 and the lamp capsule 20, may be positioned in a reflector housing 26 having a reflective surface 28 defining an optical cavity 30. The optical cavity 30 may be covered by a lens 32.

The planar transmission line 16 includes a substrate 34 having a patterned conductor 38 formed on one surface. The conductor 38 interconnects the transmission line 14 and the electric field couplers 18 and 19. The conductor 38 is designed to provide a phase shift of 180° between couplers 18 and 19 at the frequency of source 12. The opposite surface of substrate 34 is covered with a conductive ground plane (not shown in FIG. 1). The substrate 34 is provided with a gap 40 in which the lamp capsule 20 is mounted. Typically, the lamp capsule 20 is displaced from the plane of substrate 34 and is aligned with the electric field couplers 18 and 19. The gap 40 may be rectangular and have an open side 42.

The gap 40 in which the lamp capsule 20 is positioned represents a discontinuity in the ground plane. This discontinuity causes an asymmetry to develop in the electric field distribution near the lamp capsule, as the electric field lines tend to terminate on the ground plane. On one side of the lamp capsule the ground plane is continuous, whereas, the opposite side is open and has no ground plane.

Figure 2:
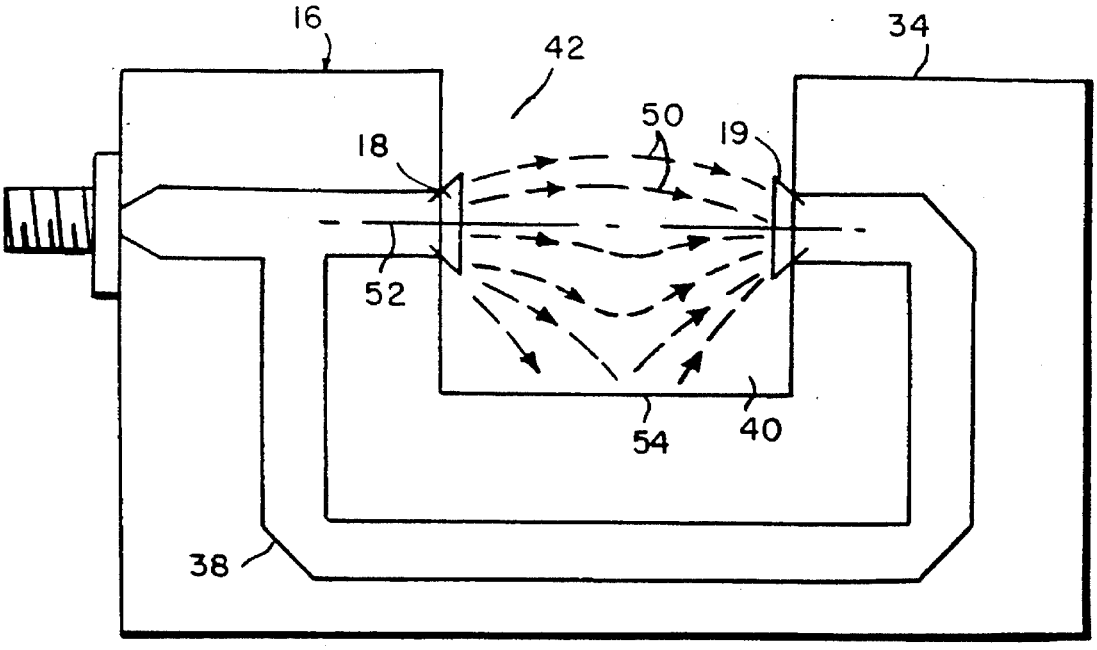
FIG. 2 PRIOR ART
FIG. 2 illustrates the electric field distribution in a prior art electrodeless HID lamp.

The planar transmission line 16, with electric field couplers 18 and 19, is shown in FIG. 2 with the lamp capsule omitted for clarity of illustration. Electric fields are represented by field lines 50. An axis 52 defines the nominal mounting position of the lamp capsule. In a region between axis 52 and an edge 54 of gap 40, the electric field lines 50 are displaced toward edge 54 and the associated ground plane. In a region between axis 52 and open side 42, electric field lines 50 extend between couplers 18 and 19. In the case of a balun type applicator as shown in FIGS. 1 and 2, the electric field asymmetry could perturb the virtual ground that is nominally located at the center of the lamp envelope, shifting it outside the lamp capsule. This adversely affects lamp performance by forcing the current channel within the plasma on or near the wall of the lamp capsule, causing arc bowing, wall overheating and in extreme cases extinguishing of the discharge. Furthermore, with no well-established virtual ground, the discharge tends to radiate unwanted electromagnetic interference.

Figure 3:
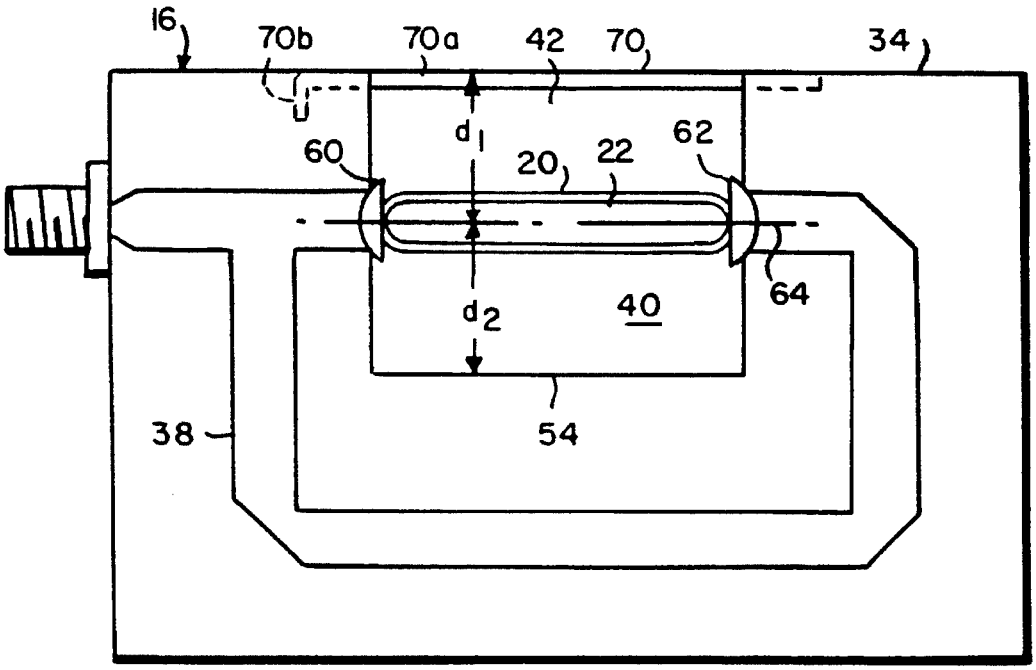
FIG. 3 shows an electrodeless HID lamp in accordance with the present invention.
Figure 4:
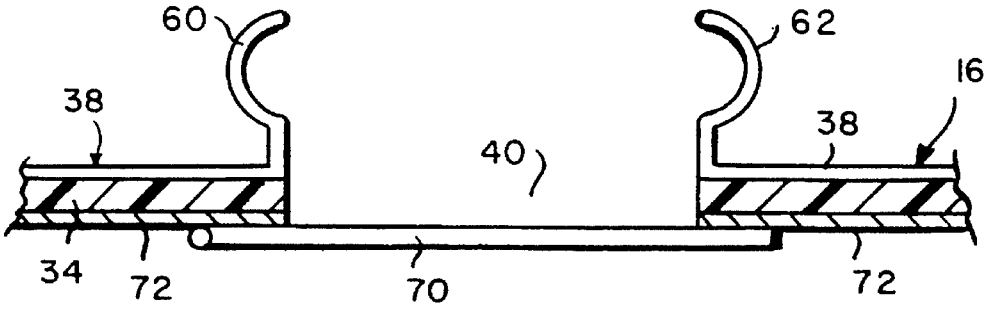
FIG. 4 is a partial cross-sectional view of the high frequency fixture of FIG. 3.

An electrodeless high intensity discharge lamp in accordance with the present invention is shown in FIG. 3. A cross section of the planar transmission line 16 in the region of gap 40 is shown in FIG. 4. Like components in FIGS. 1, 3 and 4 have the same reference numerals. Planar transmission line 16 couples high frequency power from a high frequency source (not shown in FIG. 3) to electric field applicators 60 and 62 with a 180° phase shift between applicators 60 and 62. Lamp capsule 20 is positioned on lamp axis 64 between applicators 60 and 62 in gap 40. The lamp capsule 20 contains a mixture of starting gas and chemical dopant material within enclosed volume 22 that is excitable by high frequency power to a state of luminous emission, thereby emitting visible light.

In order to symmetrize the electric field distribution in the region of lamp capsule 20, a field symmetrizing electrical conductor 70 is located in the open side 42 of gap 40. The connection of the conductor 70 is shown in more detail in FIG. 4. Planar transmission line 16 includes substrate 34 having patterned conductor 38 formed on its front surface and electrically connected to electric field applicators 60 and 62. An electrically conductive ground plane 72 covers the back surface of substrate 34. The ground plane 72 may, for example, be a copper layer adhered to substrate 34. The conductor 70 is electrically connected to ground plane 72 on opposite sides of gap 40, preferably by soldering. The conductor 70 may, for example, be a wire having a diameter in the range of about 0.001 inch to 0.040 inch. The wire may be copper or other electrically conductive material. A preferred diameter is about 0.025 inch. The wire may be bent into an L-shape as shown in FIG. 3 to facilitate positioning and soldering of the wire on the ground plane 72. In a preferred embodiment, a long leg **70*a* of the L-shaped wire is approximately 25 millimeters long, and a short leg 70*b* is approximately 4 millimeters long. The length may be varied depending on the dimensions of the gap 40**.

The purpose of the conductor 70 is to symmetrize the electric field in the region of lamp capsule 20 and, in particular, within enclosed volume 22. The conductor 70 is selected to have a relatively low inductance at the frequency of lamp operation, while minimizing light blockage. If light blockage is not a concern in the direction of conductor 70, then conductor 70 preferably has a relatively large cross-sectional area to reduce inductance. Preferably, leg **70*a* of conductor 70 is straight and is disposed substantially parallel to axis 64 of lamp capsule 20. Furthermore, distance $d_1$ between axis 64 and conductor 70 is preferably approximately equal to distance $d_2$ between axis 64 and edge 54 of gap 40**. It has been found that a thin wire meets these requirements. However, other conductor shapes and configurations are included within the scope of the present invention.

Figure 5:
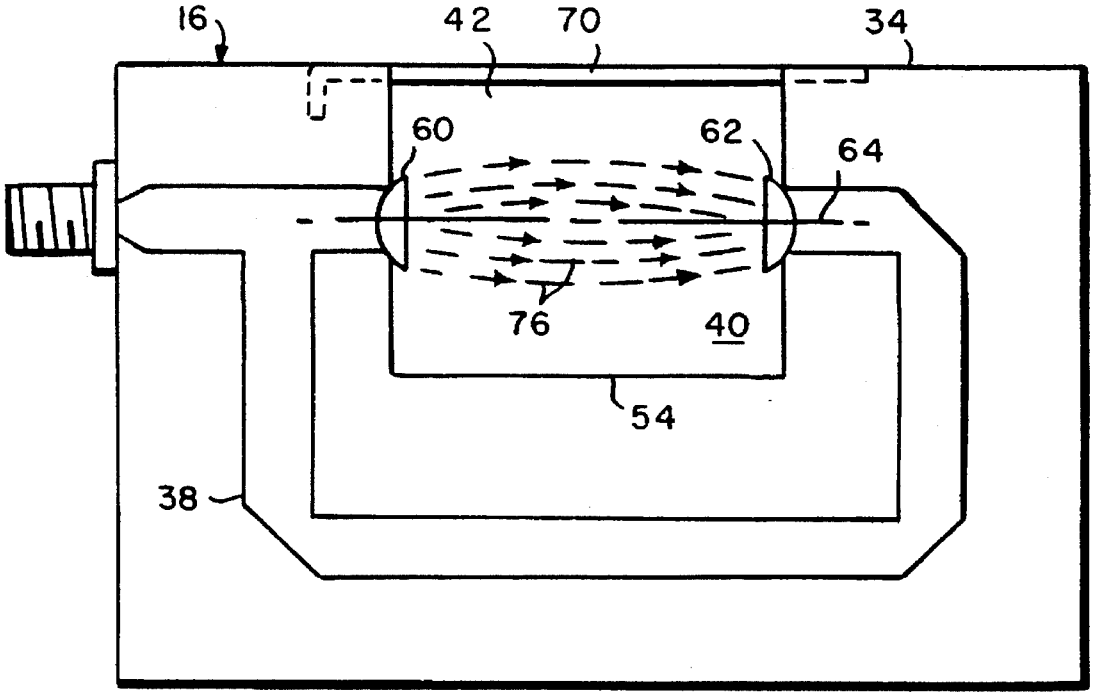
FIG. 5 shows the electric field distribution in the electrodeless HID lamp of FIG. 3.

The high frequency applicator, including planar transmission line 16 and electric field applicators 60 and 62, is shown in FIG. 5 with the lamp capsule omitted. The approximate configuration of the electric field in the region of lamp axis 64 is indicated by electric field lines 76. The electric field lines 76 are substantially symmetrical with respect to axis 64 and are substantially colinear with axis 64 in the region corresponding to the enclosed volume 22 of lamp capsule 20 (FIG. 3) between electric field applicators 60 and 62. As a result, the arc discharge within the lamp capsule 20 tends to be colinear with axis 64, and overheating of the wall of the lamp capsule is reduced in comparison with prior art electrodeless lamp configurations.

Figure 6:
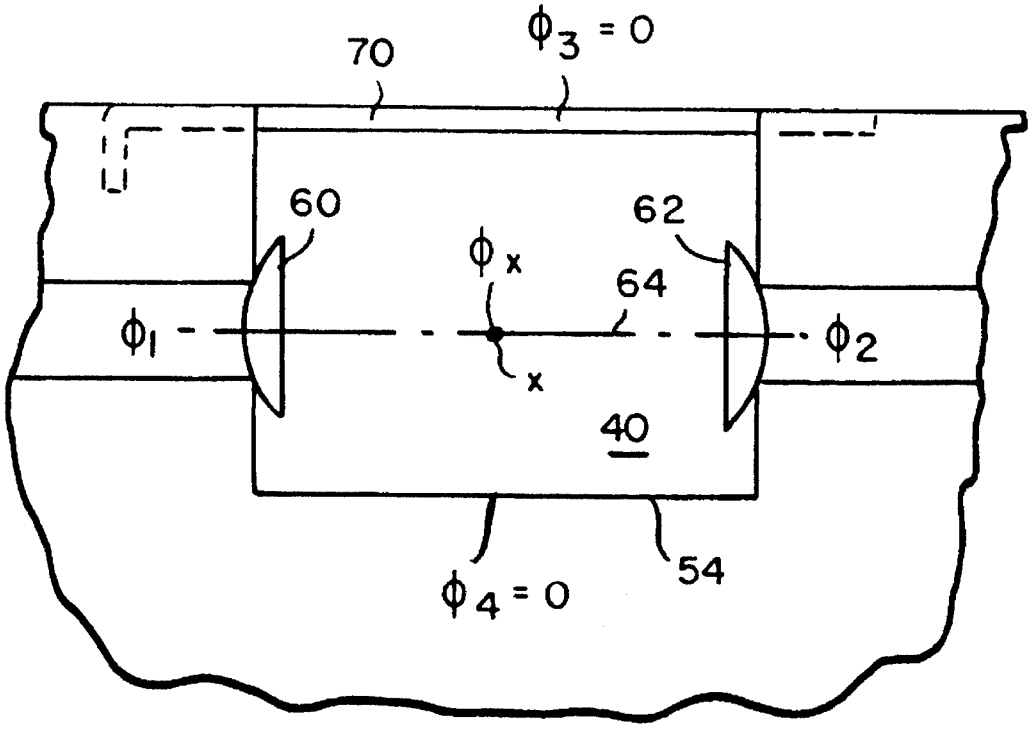
FIG. 6 is a partial schematic representation of the high frequency fixture, illustrating the position of the virtual ground in the electrodeless HID lamp of FIG. 3.

The virtual ground associated with operation of the electrodeless high intensity discharge lamp of the present invention is discussed with reference to FIG. 6. The function of the conductor 70 can be understood by considering the quasi-static approximations for the field and potential distribution in the vicinity of the lamp capsule. The potential $\phi_x$ at a point x on axis 64 equidistant between applicators 60 and 62 is given by $$\phi_x = \tfrac{1}{4}(\phi_1+\phi_2+\phi_3+\phi_4);\ \phi_1 = -\phi_2$$

$$\phi_x = \tfrac{1}{4}(\phi_1-\phi_2+0+0) = 0$$

where $\phi_1$ is the potential of applicator 60, $\phi_2$ is the potential of applicator 62, $\phi_3$ is the potential of conductor 70 (ground) and $_\phi_4$ is the potential of the ground plane 72 along edge 54 (ground). Since the potentials on applicators 60 and 62 are 180° out of phase, point x is effectively a virtual ground. In the absence of the conductor 70, the virtual ground, the point where the average potential is zero, may be displaced exterior to the lamp capsule, causing the problems discussed above. When the virtual ground is located at point x equidistant between applicators 60 and 62 on lamp axis 64, electrons in the plasma are accelerated by the high frequency fields toward the virtual ground. The field then reverses direction, causing the electrons to be accelerated from the virtual ground toward the other applicator. This process is repeated on each cycle of the radio frequency field, causing the electrons to oscillate within the lamp capsule.

The plasma within the lamp capsule can be considered as a lossy dielectric in the gap 40 and oriented colinear with the lamp axis 64. Accordingly, the strength of the field and the value of the potential are modified by the dielectric, but the position of the virtual ground remains in the center of the lamp capsule for the case with the conductor 70 present. Absent the conductor 70, the virtual ground is displaced from the lamp axis 64.

The lamp capsule 20 is preferably substantially cylindrical in shape with hemispherical ends. The dimensions of the lamp capsule are typically given as (inner diameter×outer diameter×arc length), all in millimeters. Typical lamp capsules range from 1×3×6 millimeters to 5×7×17 millimeters. For operation in the preferred ISM (Industrial, Scientific and Medical) bands centered around 915 Megahertz and 2.45 Gigahertz, the lamps are typically 2×4×10 millimeters and 2×3×6 millimeters, respectively, for best performance. The envelope of the lamp capsule is fabricated of a light-transmissive material through which the high frequency power passes substantially unattenuated. The material of the lamp envelope may be vitrious silica, commonly called quartz, of any grade, but water free grades are especially preferred. Synthetic fused silica may also be utilized to fabricate the lamp envelope. When the discharge can be run at lower wall temperatures, the lamp envelope may be fabricated of other glassy material, such as aluminosilicate glass or borosilicate glass.

The lamp capsule is filled with a volatilizable fill material and a low pressure inert gas for starting, such as argon, krypton, xenon or nitrogen in the range of 1 to 100 Torr, with a preferred value of 15 Torr. The volatilizable fill material, when volatized, is partially ionized and partially excited to radiating states so that useful light is emitted by the discharge. The fill material can be mercury and NaSc halide salt or other metal salts. Other fill materials not containing mercury may also be utilized. When the lamp capsule is operating and hot, the internal pressure is between 1 and 50 atmospheres. Other fill materials known to those skilled in the art may be utilized to generate visible, ultraviolet or infrared radiation.

The electric field applicators 60 and 62 may comprise helical couplers as disclosed in the aforementioned U.S. Pat. No. 5,070,277; end cup applicators as disclosed in the aforementioned U.S. Pat. No. 5,241,246; loop applicators as disclosed in the aforementioned U.S. Pat. No. 5,130,612; or any other suitable electric field applicator. In general, the electric field applicators produce a high intensity electric field within the enclosed volume of the lamp capsule so that the applied high frequency power is absorbed by the plasma discharge.

The electrodeless HID lamp of the present invention can operate at any frequency in the range of 13 Megahertz to 20 Gigahertz at which substantial power can be developed. The operating frequency is typically selected in one of the ISM bands. The frequencies centered around 915 Megahertz and 2.45 Gigahertz are particularly appropriate.

The planar transmission line 16 is designed to couple high frequency power at the operating frequency to the electric field applicators 60 and 62 with a 180° phase shift. The design and construction of planar transmission lines for transmission of high frequency power are well known to those skilled in the art. The substrate 34 of the planar transmission line is a dielectric material, such as for example glass microfiber reinforced PTFE (poly tetrafluoethylene) composite laminate having an approximate relative dielectric constant of 2.55 and having a thickness of 0.062 inch. The conductor 38 is patterned on one surface of the substrate, and a ground plane conductor is formed on the opposite surface of the substrate. Examples of suitable planar transmission lines include stripline and microstripline transmission lines.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electrodeless high intensity discharge lamp comprising:

an electrodeless lamp capsule having an enclosed volume containing a mixture of starting gas and chemical dopant material excitable by high frequency power to a state of luminous emission, said lamp capsule having a longitudinal axis;

a first electric field applicator and a second electric field applicator positioned so that the enclosed volume of the lamp capsule is between the first and second electric field applicators;

a planar transmission line comprising a substrate having a patterned conductor on a first surface for coupling high frequency power from an input to said first and second electric field applicators and a ground plane on a second surface, said substrate and said ground plane having a gap with an open side for positioning said lamp capsule between said first and second electric field applicators; and a field symmetrizing conductor located in the open side of said gap and electrically connected to the ground plane, said field symmetrizing conductor being positioned such that an electric field in said lamp capsule is substantially symmetrical with respect to said axis and is substantially colinear with said axis.

2. An electrodeless high intensity discharge lamp as defined in claim 1 wherein said field symmetrizing conductor comprises a conductive wire.

3. An electrodeless high intensity discharge lamp as defined in claim 2 wherein said wire has a diameter in a range of about 0.001 inch to 0.040 inch.

4. An electrodeless high intensity discharge lamp as defined in claim 2 wherein said wire is disposed parallel to the axis of said lamp capsule.

5. An electrodeless high intensity discharge lamp as defined in claim 2 wherein said wire has a diameter selected to provide relatively low inductance at the frequency of said high frequency power and to provide relatively low blockage of light emitted by said lamp capsule.

6. An electrodeless high intensity discharge lamp as defined in claim 2 wherein said lamp capsule is generally cylindrical in shape and wherein said wire is disposed parallel to the longitudinal axis of said lamp capsule.

7. An electrodeless high intensity discharge lamp as defined in claim 2 wherein said wire is L-shaped to facilitate attachment to said ground plane.

8. An electrodeless high intensity discharge lamp as defined in claim 1 wherein said gap has an edge opposite said open side and wherein said edge and said field symmetrizing conductor are approximately equidistant from the longitudinal axis of said lamp capsule.

9. An electrodeless high intensity discharge lamp as defined in claim 1 wherein said field symmetrizing conductor is positioned to produce a virtual ground within the enclosed volume of said lamp capsule and equidistant between said first and second electric field applicators.

10. An electrodeless high intensity discharge lamp comprising:

an electrodeless lamp capsule having an enclosed volume containing a starting gas and a fill material for emitting visible light upon excitation by high frequency power, said lamp capsule having a longitudinal axis;

a first electric field applicator and a second electric field applicator positioned so that the enclosed volume of the lamp capsule is between the first and second electric field applicators;

a planar transmission line comprising a substrate having a patterned conductor on a first surface for coupling high frequency power from an input to said first and second electric field applicators and a ground plane on a second surface, said planar transmission line having a gap with an open side for positioning said lamp capsule between said first and second electric field applicators; and means coupled to said ground plane of said planar transmission line for symmetrizing an electric field in the enclosed volume of said lamp capsule with respect to said longitudinal axis.

11. An electrodeless high intensity discharge lamp as defined in claim 10 wherein said means for symmetrizing said electric field comprises a thin wire electrically connected to the ground plane on opposite sides of said gap.

12. An electrodeless high intensity discharge lamp as defined in claim 11 wherein said wire has a diameter in a range of about 0.001 inch to 0.040 inch.

13. An electrodeless high intensity discharge lamp as defined in claim 11 wherein said wire is disposed parallel to the axis of said lamp capsule.

14. An electrodeless high intensity discharge lamp as defined in claim 11 wherein said gap has an edge opposite said open side and wherein said edge and said wire are approximately equidistant from the longitudinal axis of said lamp capsule.

15. A fixture for applying high frequency power to an electrodeless lamp capsule comprising:

a planar transmission line comprising a substrate having a patterned conductor on a first surface and a ground plane on a second surface, said substrate and said ground plane having a gap with an open side for positioning the lamp capsule;

a first electric field applicator and a second electric field applicator positioned on opposite sides of said gap and electrically coupled to said patterned conductor; and a field symmetrizing conductor located in the open side of said gap and electrically connected to said ground plane, said field symmetrizing conductor being positioned such that an electric field between said first and second electric field applicators is substantially symmetrical in a region between said first and second electric field applicators.

16. A fixture as defined in claim 15 wherein said conductor comprises a wire.

17. A fixture as defined in claim 16 wherein said wire has a diameter in a range of about 0.001 inch to 0.040 inch.

* * * * *